US007434390B2

(12) United States Patent
Nording et al.

(10) Patent No.: US 7,434,390 B2
(45) Date of Patent: Oct. 14, 2008

(54) AIR-GAP-INSULATED EXHAUST MANIFOLD

(75) Inventors: Thomas Nording, Esslingen (DE); Thomas Beck, Aichwald (DE)

(73) Assignee: J. Eberspacher GmbH & Co. KG (DE)

( * ) Notice: Subject to any disclaimer, the term of this patent is extended or adjusted under 35 U.S.C. 154(b) by 549 days.

(21) Appl. No.: 11/116,027

(22) Filed: Apr. 27, 2005

(65) Prior Publication Data

US 2005/0241303 A1 Nov. 3, 2005

(30) Foreign Application Priority Data

Apr. 29, 2004 (DE) ..... 10 2004 021 196

(51) Int. Cl.
*F01N 7/10* (2006.01)

(52) U.S. Cl. ..... 60/323; 60/324

(58) Field of Classification Search ..... 60/313, 60/322, 323, 324
See application file for complete search history.

(56) References Cited

U.S. PATENT DOCUMENTS 5,768,890 A * 6/1998 Bekkering et al. ..... 60/305
6,247,552 B1 6/2001 Kovar et al.
6,343,417 B1 2/2002 Bonny et al.

FOREIGN PATENT DOCUMENTS

DE 44 44 760 A1 6/1996
EP 1 229 221 A1 8/2002
EP 1 329 607 A2 7/2003

* cited by examiner

*Primary Examiner*—Thomas Denion
*Assistant Examiner*—Diem Tran
(74) *Attorney, Agent, or Firm*—Wildman, Harrold, Allen & Dixon LLP

(57) ABSTRACT

The present invention relates to an air-gap-insulated exhaust manifold (1) of an internal combustion engine, in particular in a motor vehicle, having a collecting line (2) that extends in a longitudinal direction (3), an outlet opening (4) oriented in the longitudinal direction (3), multiple inlet openings (5) oriented across the longitudinal direction (3) and a flange (6) that extends in the longitudinal direction (3) and includes the inlet openings (5), wherein an inside pipe (11) is situated in an outside pipe (10), forming an air-gap insulation, and whereby a gas-carrying outside pipe section (13) is provided in the area of at least one of the inlet openings (5) and leads from the respective inlet opening (5) to an assigned inside pipe inlet (14) which is at a distance from the flange (6). The inside pipe (11) is attached to the outside pipe (10) only in an attachment area (15).

13 Claims, 1 Drawing Sheet

AIR-GAP-INSULATED EXHAUST MANIFOLD

CROSS REFERENCE TO RELATED APPLICATION

This application claims priority of German Patent Application No. DE 102004021196.5 filed on April 29, 2004.

BACKGROUND OF THE INVENTION

The present invention relates to an air-gap-insulated exhaust manifold of an internal combustion engine, in particular in a motor vehicle, having the features of the preamble of claim 1.

Such an exhaust manifold is known from DE 44 760 A1, for example, and includes a collecting line extending in a longitudinal direction, an outlet opening oriented in the longitudinal direction, multiple inlet openings oriented across the longitudinal direction and a flange that contains the inlet openings and extends in the longitudinal direction. Such an exhaust manifold is formed by an outside pipe mounted on the flange and by an inside pipe inserted into the outside pipe, forming an air-gap insulation. A design which saves on materials is achieved with the known exhaust manifold by the fact that a gas-carrying outside pipe section which is provided in the area of at least one of the inlet openings leads from the respective inlet opening to a respective inside pipe inlet at a distance from the flange.

This design takes into account the fact that the areas of the exhaust manifold in direct proximity to the inlet opening are under less thermal stress than the collecting line in which there is an increased mass flow of hot exhaust gases and a detour in the exhaust gases. Omitting the inside pipe in the area of the inlet openings permits a considerable savings of material.

Air-gap-insulated double-wall exhaust manifolds are being used increasingly in the exhaust systems of internal combustion engines, in particular in motor vehicles, where they ensure optimum operation of a downstream catalyst. First, they cause a reduced dissipation of the heat of the exhaust gas to the environment so that the exhaust can be sent to the respective catalyst at a higher temperature. This is important in particular during the warm-up phase of the internal combustion engine because the catalyst may then reach its operating temperature very rapidly. Secondly, the air-gap-insulated exhaust manifolds reduce the heat acting upon components, arranged adjacent to the exhaust manifold in the engine space, for example.

In the case of exhaust manifolds of this type, the air-gap insulation necessarily results in the inside pipe being exposed to higher temperatures than the outside pipe. Consequently, the inside pipe expands more than the outside pipe during operation of the internal combustion engine. The resulting problems lead more complex designs with the known traditional exhaust manifolds. For example, the inside pipe may be designed in multiple parts, in which case the individual inside pipe parts are mounted so they are movable with respect to one another via sliding seats. In this way the individual inside pipe parts are able to move toward one another to compensate for thermal expansion. However, the manufacturing cost associated with this is comparatively high.

BRIEF SUMMARY OF THE INVENTION

The present invention addresses the problem of providing a simplified embodiment for an exhaust manifold of the type defined in the preamble which can be manufactured at a reduced cost in particular.

This problem is solved according to this invention through the object of the independent claim. Advantageous embodiments are the object of the dependent claims.

The present invention is based on the general idea of mounting the inside pipe on the outside pipe only in a fixation area which is approximately at the center with regard to the longitudinal extent of the exhaust manifold. This longitudinal extent is predetermined by the greatest dimension of the exhaust manifold and runs essentially parallel to the longitudinal direction of the collecting line and the flange. The greatest thermal expansion of the exhaust gas pipe and/or the inside pipe in relation to the outside pipe occurs in this longitudinal direction during operation of the internal combustion engine. Due to the targeted positioning of the fixation area at the center of the longitudinal extent, the expected relative movements are minimized. In addition, according to this invention, the inside pipe is to be arranged so that it is movable in relation to the outside pipe outside of the fixation area at least in the longitudinal direction, which permits thermal expansion of the inside pipe in relation to the outside pipe with almost no stress at least in the longitudinal direction. Thermal stresses may thus be avoided at least in the longitudinal direction. This essentially yields the possibility of designing the inside pipe in one piece. In particular a multipart design with inside pipe parts telescoped together is not necessary. It is noteworthy here that at the same time the material-saving advantages of known exhaust manifolds can be utilized again here because a gas-carrying outside pipe section is still provided in the area of at least one inlet opening.

An embodiment in which the attachment area is designed exclusively in the area of the inlet opening which is arranged approximately centrally with respect to the longitudinal extent of the exhaust manifold is especially advantageous. A fixed connection between the inside pipe and the outside pipe can be established especially easily in the area of this inlet opening. For example, the inside pipe is inserted into the outside pipe in the area of the inlet opening and is soldered and/or welded to it.

Another advantageous embodiment is obtained when the outlet opening is arranged at an outlet end of an inlet funnel for a catalyst, where the collecting line develops into the inlet funnel, in particular being designed in one piece with it. In this way, an additional functionality, namely that of the inlet funnel of the catalyst, is integrated into the exhaust manifold, which on the whole reduces the manufacturing cost of an exhaust system equipped with this exhaust manifold. The principle of air-gap insulation can also be implemented especially inexpensively in the area of the inlet funnel.

Other advantageous features and advantages of this invention are derived from the sub claims, the drawings and the respective description of the figures with reference to the drawings.

It is self-evident that the features mentioned above and to be further explained below can be used not only in the combination given in each case but can also be used in other combinations or even alone without going beyond the scope of the present invention.

A preferred exemplary embodiment of this invention is illustrated in the drawings and is explained in greater detail in the following description, where the same reference notation is used to refer to the same or functionally same or similar parts.

BRIEF DESCRIPTION OF THE DRAWINGS

The figures show, schematically in each case

DETAILED DESCRIPTION OF THE INVENTION

Figure 2:
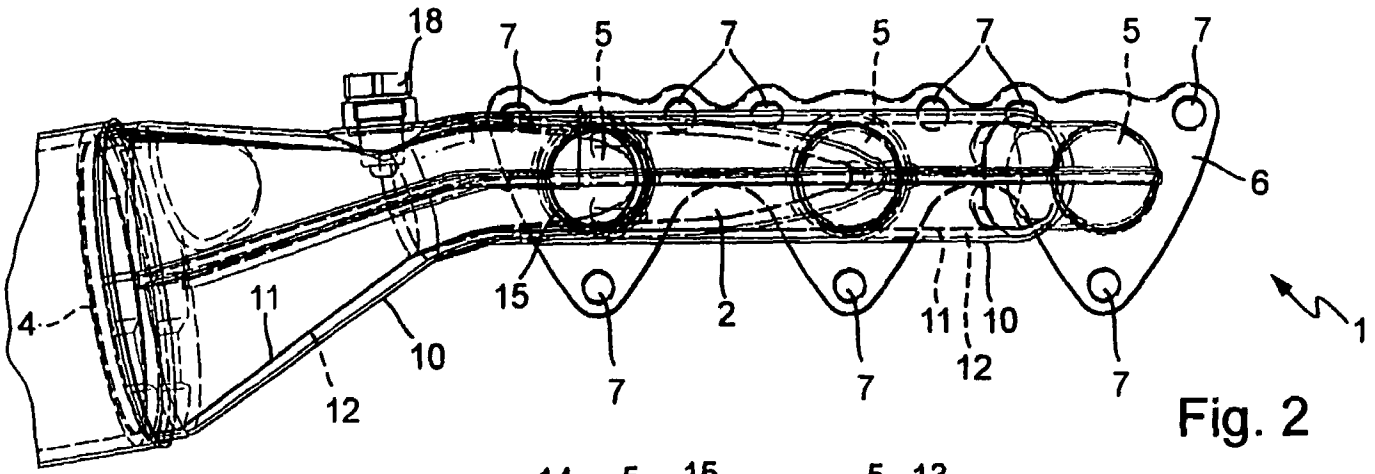
FIG. 2 a side view of the exhaust manifold according to an arrow II in FIG. 1.
Figure 1:
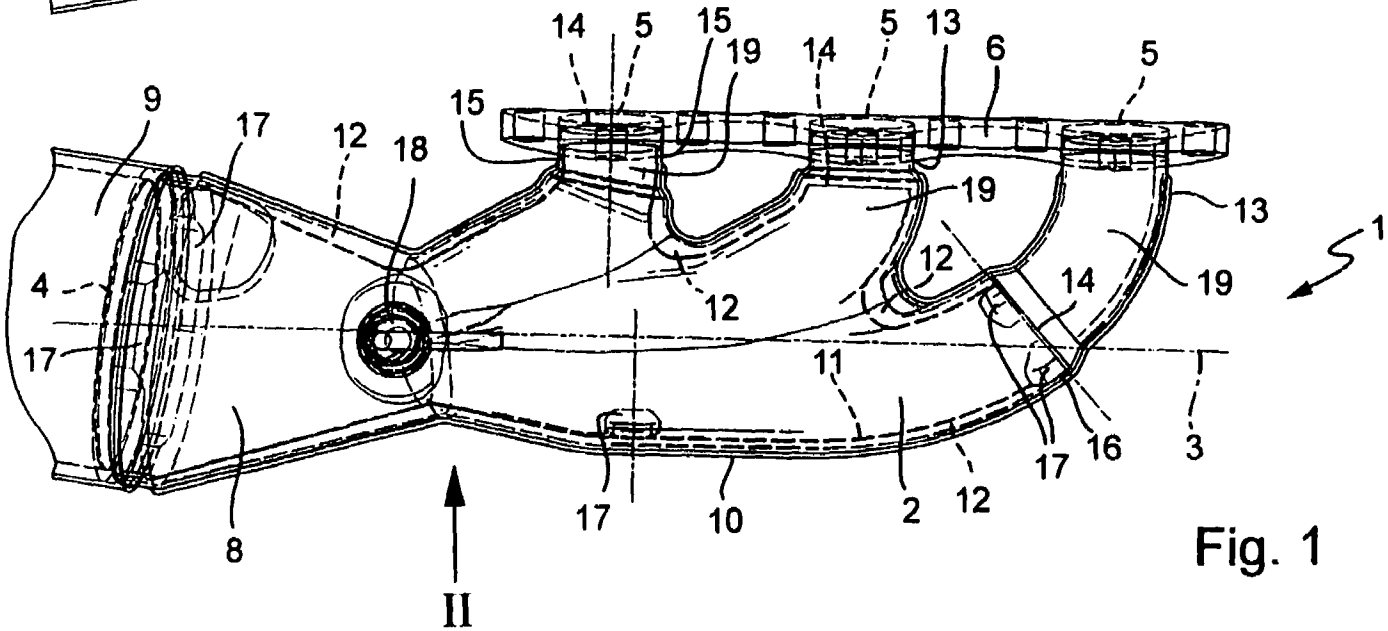
FIG. 1 a top view of an inventive exhaust manifold.

According to FIGS. 1 and 2, an exhaust manifold 1 according to this invention includes a collecting line 2 which extends in a longitudinal direction 3 indicated by an interrupted line; it also includes an outlet opening 4 which is oriented essentially in the longitudinal direction 3 as well as several inlet openings 5, three of which are shown here as an example, each being oriented essentially across the longitudinal direction 3. The orientation of the openings 4, 5 is obtained from the normal direction of the respective plane of the opening in which the respective opening 4, 5 is situated. At the same time, the orientation of the respective opening 4, 5 corresponds to the main direction of flow within the respective opening 4, 5.

In addition, the exhaust manifold 1 includes a flange 6 which also extends in the longitudinal direction 3 and/or parallel to that and includes the inlet openings 5. The exhaust manifold 1 can be attached to an engine block of an internal combustion engine, e.g., by means of screws that can be pushed through plug openings 7 provided on the flange 6. The exhaust manifold 1 thus forms a transition from the internal combustion engine to an exhaust line of the internal combustion engine, in particular in a motor vehicle.

Individual lines 19 lead away from the collecting line 2, each leading to one of the inlet openings 5. In addition, in the preferred embodiment illustrated here, the collecting line 2 develops into an inlet funnel 8 through which the exhaust gas enters a downstream catalyst situated directly downstream from the exhaust manifold 1 in the exhaust line.

From its outlet opening 4 to its inlet openings 5, the exhaust manifold 1 consists of an outside pipe 10 and an inside pipe 11 which is inserted into the outside pipe 10, forming an air-gap insulation. Accordingly, this is an air-gap-insulated or double-walled exhaust manifold 1. One particular aspect of this design is that a gas-carrying outside pipe section 13 is provided in the area of at least one inlet opening, namely here in the area of two inlet openings 5, i.e., in the area of the two inlet openings 5 shown at the right of the figure. These outside pipe sections 13 lead from the respective inlet opening 5 to an assigned inside pipe inlet 14, which is arranged at a distance from the flange 6. In this way, the gas is not guided in the inside pipe 11 but instead in the outside pipe 10 between the respective inside pipe inlet 14 and the assigned inlet opening 5. This is possible because in the area of the individual lines 19 the thermal load is less pronounced than downstream from that in the collective line 2. As a result, due to the gas-carrying outside pipe sections 13, material can be saved, i.e., on the inside pipe 11. At the same time, the this reduces the problems that can occur in conjunction with differences in thermal expansion.

Thus with the exhaust manifold according to this invention, the inside pipe 11 is mounted on the outside pipe 10 only in an attachment area 15. This attachment area 15 is selected in a targeted manner so that it is situated approximately centrally with respect to the longitudinal direction 3 between the outlet opening 4 shown at the left of the figure and the inlet opening 5 shown at the right of the figure, this opening being the one at the greatest distance away from the outlet opening 4. At the same time, the inside pipe 11 is arranged to be movable in relation to the outside pipe 10 at least in the longitudinal direction 3 outside of this attachment area 15. The thermal expansion of the inside pipe 11 in the direction of the outlet opening 4 and in the opposite direction is minimized due to the central attachment of the inside pipe 11 to the outside pipe 10. At the same time, relative movements between the inside pipe 11 and the outside pipe 10 outside of the attachment area 15 are made possible due to the mobility allowed between the inside pipe 11 and the outside pipe 10. Therefore, no thermal stresses can build up at least in the longitudinal direction 3 of the exhaust manifold according to this invention.

In the preferred embodiment illustrated here, the attachment area 15 is designed exclusively in the area of the inlet opening 5 which is shown at the left of the figure, i.e., in the area of the inlet opening 5 which is situated approximately centrally with regard to the longitudinal direction 3, i.e., between the outlet opening 4 and the inlet opening 5 which is shown at the right of the figure and is the greatest distance from the former. Consequently, the attachment area 15 is expediently designed in the form of a ring and extends in the circumferential direction of the inlet opening 5.

In the area of the individual line 19 assigned to the attachment area 15, the inside pipe 11 extends expediently up to or into the flange 6 in the attachment area 15. The inside pipe 11 here is attached in the area of the respective inlet opening 5 on the outside pipe 10. The outside pipe 10 is in turn attached to the flange 6 in the fixation area 15. In contrast with the other individual lines 19, with the individual line 19 assigned to the attachment area 15, the inside pipe 11 thus continues up to the inlet opening 5, so that the respective inside pipe inlet 14 essentially coincides with the outlet opening 5. At any rate, no gas-carrying outside pipe section 13 is provided with this individual line 19. The gas-carrying outside pipe sections 13 are thus provided only in the area of the inlet openings 5 which are situated outside of the attachment area 15.

A particular feature is also seen in the embodiment of the transition between the inside pipe 11 and the outside pipe 10 which is implemented in the individual line 19 which is at the greatest distance from the inlet opening 5 and thus leads to the inlet opening 5 shown at the right in the figure. The inside pipe 11 is movably mounted in this transition via a sliding seat 16 in the outside pipe 10. This sliding seat 16 permits guided relative movements between the inside pipe 11 and the outside pipe 10 which have a significant component in the longitudinal direction 3. In the embodiment depicted here, the sliding seat 16 is implemented in an exemplary fashion by multiple locally limited spacer elements 17 which are distributed around the circumference in the area of the respective inside pipe inlet 14 and are produced, for example, by stamping directly on the inside pipe 11. Such spacer elements 17 lead to a locally limited superficial contact between the inside pipe 11 and the outside pipe 10 and serve to position the inside pipe 11 on the outside pipe 10. At the same time, such spacer elements 17 permit relative displacement of the two pipes 10, 11 with respect to one another. Other spacer elements 17 may also be provided along the inside pipe. Other spacer elements 17 are provided as an example here along the circumference of the outlet opening 4. Likewise, another spacer element 17 is also provided opposite the inlet opening 5 which is equipped with the attachment area 15.

The spacer elements 17 may also be formed additionally or alternatively by stamped or embossed areas on the outside pipe 10.

Although the sliding seat 16 in the area of the inlet opening 5 which is at the greatest distance away from the attachment area 15 readily permits comparatively large relative adjustments between the inside pipe 11 and the outside pipe 10, another embodiment is depicted here as the example of the area of the central inlet opening 5; this embodiment may be used as an alternative or, as is the case here, additionally in the area of at least one inlet opening 5 which is outside the attachment area 15. In the area of the central inlet opening 5, the inside pipe 11 has an inside pipe inlet 14 which is oriented essentially parallel to the respective inlet opening 5, i.e., across the longitudinal direction 3. In addition, this inside pipe inlet 14 is situated to be free-standing in front of the outside pipe section 13 which leads from the respective inlet opening 5 to the inside pipe inlet 14. Free-standing here means that the inside pipe 11 has some play with respect to the outside pipe 10 in the area of the inside pipe inlet 14 at least parallel to the longitudinal direction 3, so that in this area the inside pipe 11 can move with said inside pipe inlet 14 in the longitudinal direction 3 in relation to the outside pipe 10. At the same time, this play ensures the development of the air-gap insulation 12 in this area. One particular design detail in a preferred embodiment is that the dimensions of the inside pipe 11 and the outside pipe 10 are expediently coordinated so that the inside pipe inlet 14 which is parallel to the inlet opening 5 is aligned approximately centrally with the inlet opening 5 at the operating temperature. At the same time, the dimensions of the inlet opening 5 and the inside pipe inlet 14 may advantageously be coordinated so as to achieve the lowest possible flow resistance from the inlet opening 5 into the inside pipe 11 to prevent leakage flow in the annular gap which develops in the area of the inside pipe inlet 14 between the outside pipe 10 and the inside pipe 11 in the area of the inside pipe inlet 14. When cold, the inside pipe inlet 14 is arranged with an eccentric offset with respect to the longitudinal direction 3 and with respect to the respective inlet opening 5 so that the inside pipe 11 more or less refrains from thermal expansion in this area due to the design.

In the preferred embodiment shown here, the inlet funnel 8 which widens toward the catalyst 9 is integrated into the collecting line 2, i.e., the inlet hopper 8 here also forms an integral part of the exhaust manifold 1. In this way the technical flow transition between the collecting line 2 and the inlet hopper 8 and/or the catalyst 9 can be implemented in a design with a low resistance, whereby at the same time an especially effective air-gap insulation from the catalyst 9 can be achieved.

The outside pipe 10 is usually composed of two half shells which are fixedly joined together in a suitable heat resistant manner, e.g., by flanging, soldering and/or welding. In a preferred embodiment here, the inside pipe 11 is designed in one piece, i.e., the inside pipe 11 forms a single cohesive body in the completely installed state. The inside pipe 11 may in fact be manufactured in one piece, e.g., by an inside high-pressure upsetting method or a hydro forming method. It is likewise possible for the inside pipe 11 to be assembled from multiple individual parts, preferably from two half shells, whereby the individual parts, i.e., preferably the half shells, are fixedly joined together, e.g., by flanging, soldering and/or welding. The one-piece design for the inside pipe 11 permits and especially inexpensive production of the inside pipe 11 and ultimately also a similarly inexpensive production for the exhaust manifold 1. This one-piece design of the inside pipe 11 is made possible in particular by the attachment proposed according to this invention between the inside pipe 11 and the outside pipe 10 exclusively in the attachment area 15 which is arranged centrally with respect to the longitudinal extent of the exhaust manifold 1. The thermal expansion in the longitudinal direction 3 takes place toward both sides due to the central attachment which is implemented here expediently in the area of the inlet opening 5 which is arranged approximately at the center of the longitudinal extent of the exhaust manifold 1 and therefore the thermal expansion is of a relatively small amount. The thermal expansion is comparatively minor across the longitudinal direction 3 and it may be absorbed by elastic bending deformation of the inside pipe 11, among other things.

This bending deformation of the inside pipe 11 may be facilitated in particular by the fact that the inside pipe preferably has a smaller wall thickness than the outside pipe. For example, the wall thickness of the inside pipe 11 is at least 50% smaller, preferably between 50% and 80% smaller than the wall thickness of the outside pipe 10. therefore, the inside pipe 11 can bulge outward toward the outside pipe 10, especially also in the area of the spacer elements 17. For example, the outside shell 10 may be approximately 1.5 mm thick while the inside shell is approximately 0.3 to 0.5 mm thick. In addition, the inside shell 11 and the outside shell 10 may be made of different materials to optimize the load bearing capacity and lifetime of the exhaust manifold 1.

To achieve a preferred bulging behavior of the inside pipe 11, the spacer elements 17 may also be positioned and dimensioned suitably, for example. In addition, bulges or similar structure reinforcing measures may be provided to have a controlled influence on the bulging behavior.

The exhaust manifold 1 here also includes a connection 18 for an exhaust probe, in particular a lambda probe.

In another embodiment, heat resistant bearing mats may be provided in the air-gap insulation 12 in order to improve the insulating effect, the positioning effect and the mounting and damping of the inside pipe 11. In particular, such bearing mats may also be used to achieve a gap sealing effect. Preferably there is a controlled, locally limited arrangement and/or positioning of the sealing bearing mats, e.g., in the edge area of the freely ending inside pipe inlet 14 with the central inlet opening 5 and/or in the area of the sensor mount 18.

We claim:

1. An air-gap-insulated exhaust manifold of an internal combustion engine, in particular in a motor vehicle, comprising a collecting line (2) extending in a longitudinal direction (3), an outlet opening (4) oriented in the longitudinal direction (3), multiple inlet openings (5) oriented along the longitudinal direction (3) and a flange (6) extending in the longitudinal direction (3) and including the inlet openings (5), wherein an inside pipe (11) is disposed in an outside pipe (10), forming air-gap insulation (12), wherein a gas-carrying outside pipe section (13) is provided in the area of at least one of the inlet openings (5), leading from the respective inlet opening (5) to a respective inside pipe inlet (14) at a distance from the flange (6), characterized in that the inside pipe (11) is mounted on the outside pipe (10) exclusively in one attachment area (15) which is arranged with respect to the longitudinal direction (3) approximately centrally between the outlet opening (4) and the inlet opening (5) which is at the greatest distance from the outlet opening (4), the inside pipe (11) is arranged movably at least in the longitudinal direction (3) in relation to the outside pipe (10) outside of the attachment area (15).

2. The exhaust manifold according to claim 1, characterized in that a gas-carrying outside pipe section (13) is provided in the area of the inlet openings (5) disposed outside of the attachment area (15).

3. The exhaust manifold according to claim 1,
characterized in that
the inside pipe (11) is movably mounted via a sliding seat (16) in the outside pipe (10) in the area of at least one inlet opening (5) disposed outside of the attachment area (15).

4. The exhaust manifold according to claim 1,
characterized in that
the collecting line (2) forms an inlet funnel (8) for a catalyst (9), wherein the outlet opening (4) is disposed at the outlet end of the inlet funnel (8).

5. The exhaust manifold according to claim 1,
characterized in that
the inside pipe (11) is positioned on the outside pipe (10) by means of locally limited spacer elements (17) which are stamped on the inside pipe (11) and/or on the outside pipe (10) and which allow displacement between the inside pipe (11) and the outside pipe (10) in the longitudinal direction (3).

6. The exhaust manifold according to claim 1,
characterized in that
the inside pipe (11) has a smaller wall thickness, in particular at least 50% smaller than the wall thickness of the outside pipe (10).

7. The exhaust manifold according to claim 1,
characterized in that
at least one bearing mat is provided in the air-gap insulation (12) and is limited at least locally.

8. The exhaust manifold according to claim 1,
characterized in that
the attachment area (15) is formed only in the area of the inlet opening (5) which is disposed approximately centrally with respect to the longitudinal direction (3) between the outlet opening (4) and the inlet opening (5) at the greatest distance from the outlet opening (4).

9. The exhaust manifold according to claim 8,
characterized in that
the inside pipe (11) extends up to or into the flange (6) in the attachment area (15) and is attached there to the outside pipe (10), the outside pipe (10) being attached to the flange (6) in the attachment area (15).

10. The exhaust manifold according to claim 1,
characterized in that
in the area of at least one inlet opening (5) which is disposed outside of the attachment area (15), the inside pipe (11) includes an inside pipe inlet (14) which is oriented essentially parallel to the respective inlet opening (5) and is arranged to be free-standing in front of an outside pipe section (13) which leads to the respective inlet opening (5).

11. The exhaust manifold according to claim 10,
characterized in that
the inside pipe (11) and the outside pipe (10) are mutually coordinated so that the inside pipe inlet (14) is aligned approximately centrally with the respective inlet opening (5) at operating temperature, and in a cold state, said inside pipe (11) is eccentrically offset in relation to the respective inlet opening (5) with respect to the longitudinal direction (3).

12. The exhaust manifold according to claim 1,
characterized in that
the inside pipe (11) formed of one piece.

13. The exhaust manifold according to claim 12,
characterized in that
the inside pipe (11) is produced by internal high-pressure forming or is assembled from two half shells.

* * * * *

UNITED STATES PATENT AND TRADEMARK OFFICE

CERTIFICATE OF CORRECTION

PATENT NO. : 7,434,390 B2
APPLICATION NO. : 11/116027
DATED : October 14, 2008
INVENTOR(S) : Nording et al.

It is certified that error appears in the above-identified patent and that said Letters Patent is hereby corrected as shown below:

Column 1, line 14, "manifold is known from DE 44 760 A1" should read --manifold is known from DE 44 44 760 A1--

Column 3, line 56, "At the same time, the this reduces" should read --At the same time, this reduces--

Signed and Sealed this

Seventeenth Day of March, 2009

JOHN DOLL
*Acting Director of the United States Patent and Trademark Office*